United States Patent [19]

Care et al.

[11] 4,403,698

[45] Sep. 13, 1983

[54] ROD STORAGE RACK

[75] Inventors: Donald E. Care, Eden; Edward L. Metzger, Angola, both of N.Y.

[73] Assignee: E & D Specialty Stands, Inc., North Collins, N.Y.

[21] Appl. No.: 255,754

[22] Filed: Apr. 20, 1981

[51] Int. Cl.[3] ..... E21B 19/14

[52] U.S. Cl. ..... 211/60 S; 211/151; 414/267

[58] Field of Search ..... 211/60 S, 49 S, 151, 211/189; 414/278, 267; 193/38, 40, 35 R; 312/330

[56] References Cited

U.S. PATENT DOCUMENTS

| | | | |
|---|---|---|---|
| 359,691 | 3/1887 | Reed | 211/151 X |
| 2,398,528 | 4/1946 | Hamilton | 312/330 |
| 2,769,559 | 11/1956 | Johnson | 211/151 X |
| 3,850,317 | 11/1974 | Lumier | 414/267 X |
| 4,116,343 | 9/1978 | Hall | 211/151 |
| 4,155,462 | 5/1979 | Bendel | 211/151 |

*Primary Examiner*—James T. McCall
*Assistant Examiner*—David L. Talbott
*Attorney, Agent, or Firm*—Joseph P. Gastel

[57] ABSTRACT

A rack for elongated rod-like members including a plurality of spaced substantially parallel frames mounted on a base, with each frame consisting of columns and beams for providing a plurality of openings, spaced rollers extending between columns of each frame behind said beams for supporting the rod-like members, with the beams having inclined surfaces for guiding the rod-like members into associated openings, and the beams having upper and lower edge portions so that if a bundle of rod-like members tilts during loading, the upper edge of the beam on the frame at the entry portion will bite into the underside of the bundle and the lower edge of another beam at a higher elevation within the rack will bite into the upper side of the bundle to hold the bundle in position.

17 Claims, 8 Drawing Figures

Fig. 3.
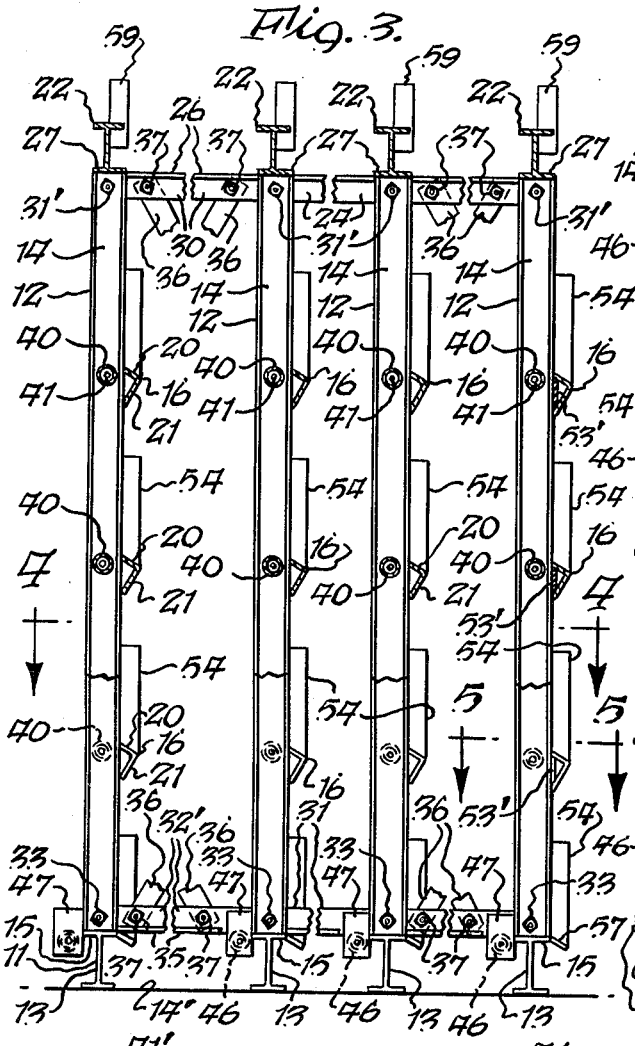
Fig. 4.
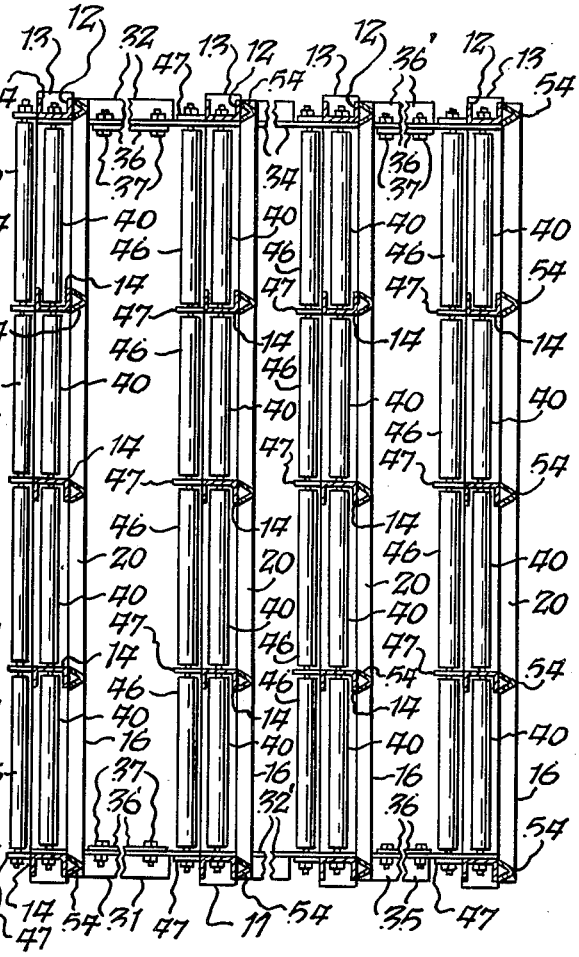
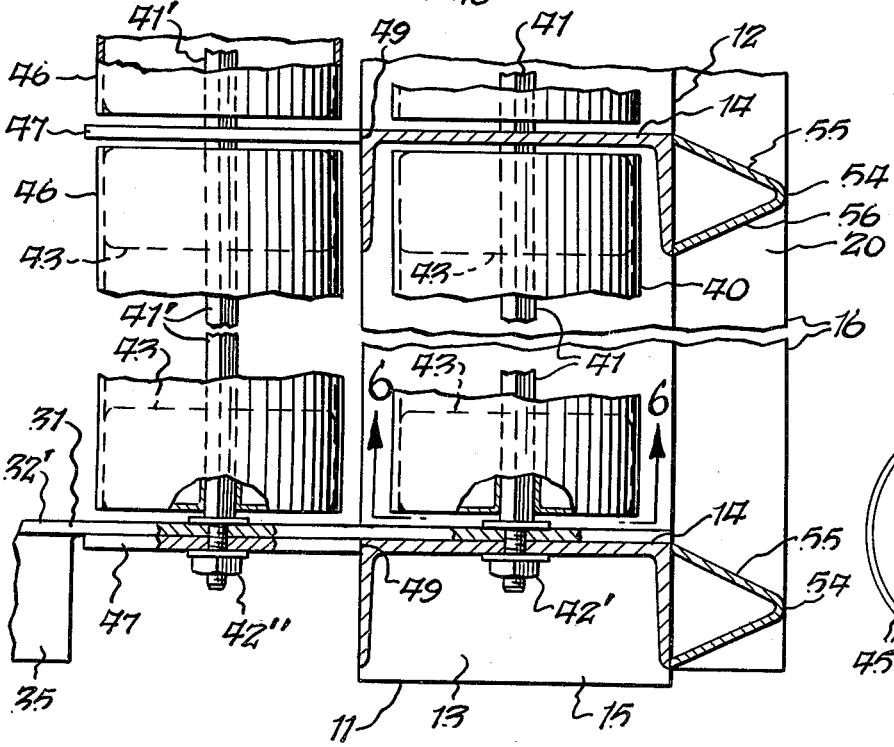
Fig. 5.
Fig. 6.
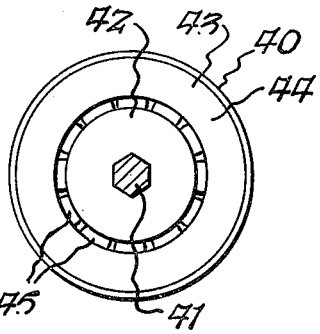

ROD STORAGE RACK

BACKGROUND OF THE INVENTION

The present invention relates to an improved rack for storing elongated rod-like members or the like.

By way of background, it is extremely difficult to load and unload rod-like members into existing storage racks. In one respect, there is no known structure to assist guiding or camming rods or bundles of rods into openings in the rack. Therefore, oftentimes the bundles will get "hung up" on the structural portions of the rack. In addition, there is no known structure on existing racks for locking a bundle of rods in position in the event that it tilts due to there being a greater portion of the bundle outside of the rack than within the rack. This factor complicates the loading of racks because external provisions must be made for holding the outer ends of the rod bundle in an elevated position throughout the loading process. It is with overcoming the foregoing deficiencies of prior rod storage racks that the present invention is concerned.

SUMMARY OF THE INVENTION

It is one object of the present invention to provide an improved rack for storage of rod-like members which will hold the bundle in a tilted position in the rack in the event that the center of gravity of the bundle lies outside of the rack, thereby obviating the necessity to use more than one external supporting member, such as a sling, during loading of the rack.

Another object of the present invention is to provide an improved rack for storage of rod-like members which contains rollers for permitting easy movement of rods or a rod bundle into and out of the rack when they are in a horizontal position, but which contains structure which automatically bites into the rods or rod bundles in the event they tilt when the center of gravity is outside of the rack.

Another object of the present invention is to provide an improved rack for storage of rod-like members which includes camming surfaces on the structural portions of the rack which guide the rod-like members into openings within the rack. Other objects and attendant advantages of the present invention will readily be perceived hereafter.

The present invention relates to a rack for elongated rod-like members comprising a base, a plurality of frames mounted in aligned spaced relationship on said base, each of said frames comprising a plurality of vertical horizontally spaced columns, a plurality of horizontal vertically spaced beam-like members affixed to the columns of each of said frames to define openings in each of said frames with corresponding openings of all of said frames being in alignment, upper and lower edges on said beam-like members for selectively biting into said rod-like members, whereby said rod-like members will be bitingly engaged by the upper edge of one of said beam-like members of a frame at the end of said rack and the lower edge of another beam-like member at a higher elevation than the upper edge of said one of said beam-like members when the ends of said rod-like members outside of said rack tilt downwardly. In addition, rollers are provided behind the upper edges of the beam-like members to support the rod-like members to support the rod-like memebers in a horizontal attitude. The beam-like members are preferably angles, the upper legs of which are inclined toward their associated openings so as to provide a camming action for guiding said rod-like members into said openings. The various aspects of the present invention will be more readily understood when the following portions of the specification are read in conjunction with the accompanying drawings wherein:

BRIEF DESCRIPTION OF THE DRAWINGS

FIG. 3 is a fragmentary cross sectional view taken substantially along line 3—3 of FIG. 2 and showing columns of each of the frames, with the beam-like angles attached thereto and the rollers mounted thereon;

FIG. 4 is a fragmentary cross sectional view taken substantially along line 4—4 of FIG. 3 and showing in plan the rollers mounted between the columns;

FIG. 5 is an enlarged fragmentary cross sectional view of the lower portions of the columns and related structure;

FIG. 6 is a cross sectional view taken substantially along line 6—6 of FIG. 5 and showing details of the roller construction;

DESCRIPTION OF THE PREFERRED EMBODIMENTS

Figures 1, 2, 7, 8:
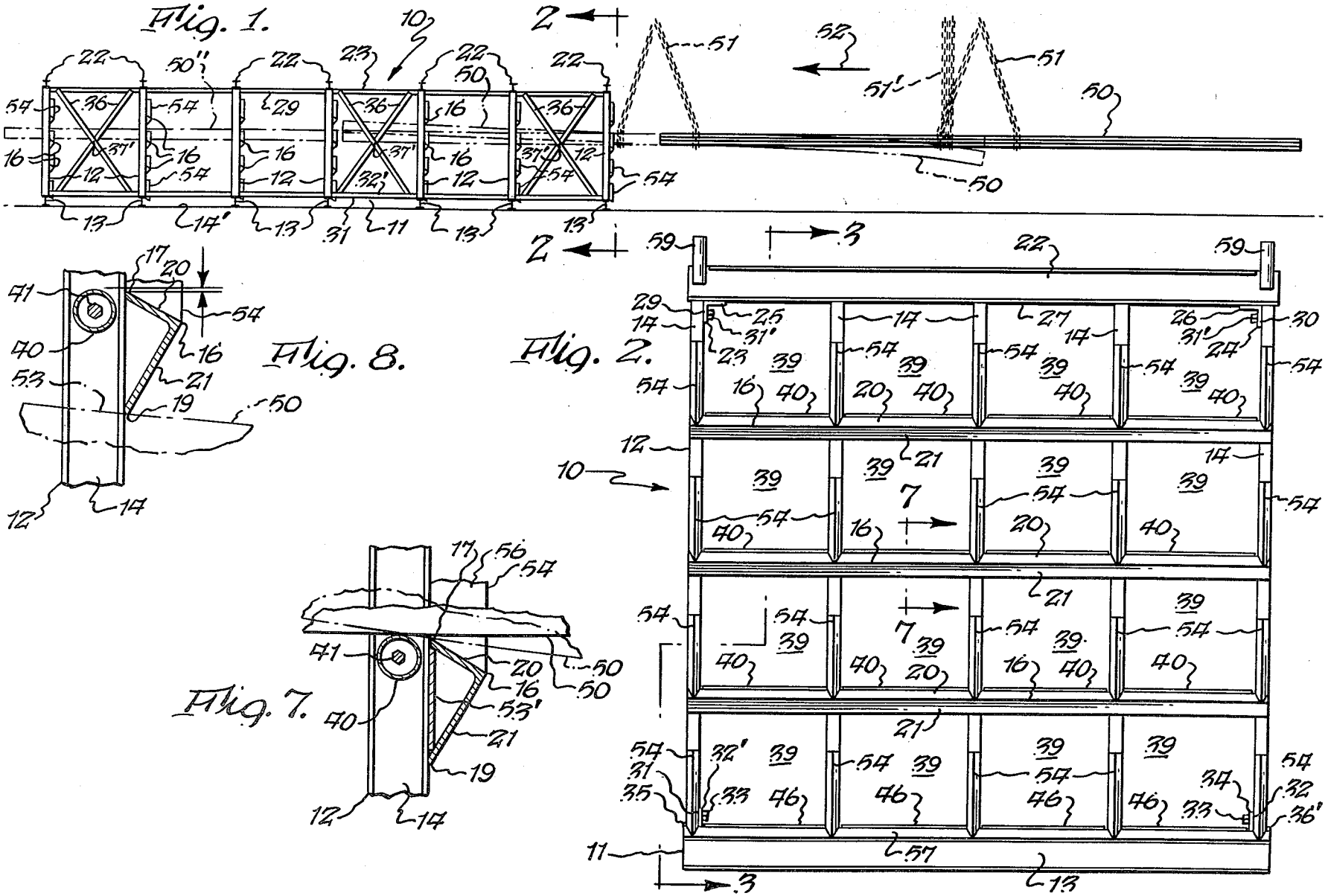
FIG. 1 is a side elevational view of the improved rod storage rack of the present invention showing how bundles of rods are loaded into the rack.
FIG. 2 is an end elevational view taken substantially in the direction of arrows 2—2 of FIG. 1 and showing the frame at the end of the rack at which rods are loaded into the rack.
FIG. 7 is a fragmentary enlarged view, partially in cross section, showing the positions taken by a rod-like member when it is supported by the roller and when it is gripped by the upper edge of the beam-like member.
FIG. 8 is a cross sectional view showing the manner in which a rod-like member is gripped by the lower edge of the beam-like member.

The improved rack 10 of the present invention essentially consists of a base 11, a plurality of frames 12 mounted on said base, and associated structure for supporting the frame 12 in spaced substantially parallel relationship. The base 11 includes a plurality of I-beams 13 which rest on floor 14' and which support each of frames 12. Each frame 12 includes a plurality of substantially vertical spaced substantially parallel column-like members in the nature of channels 14 having their lower ends affixed, as by welding, to the upper flanges 15 of I-beams 13. A plurality of substantially horizontal beam-like members in the nature of angles 16 have portions of their outer edges 17 and 19 (FIG. 7) of their legs 20 and 21, respectively, welded to the edges of channels 14 as shown. Thus, the channels 14 of each frame are joined to each other at their bottoms by I-beams 13 and along their sides by angles 16. An I-beam 22 is also welded across the tops of the channels 14 of each frame 12.

At the upper portion of the rack (FIG. 2), angles 23 and 24 have their horizontal legs 25 and 26, respectively, welded to the lower flanges 27 of I-beams 22 and their vertical legs 29 and 30, respectively, bolted to the webs of channels 14. In this respect, by way of example, leg 30 is bolted to channels 14 at 31' and leg 29 is bolted to its associated channels 14 in a like manner. At the lower portion of the rack, angles 31 and 32, which are essentially a part of base 11, are located at the junctures of the outermost channels 14 of each frame and their associated I-beams 13. By way of example, the vertical leg 32' of angle 31 is affixed to channels 14 by bolts at 33. The vertical leg 34 of angle 32 is affixed to channels 14 in a like manner. The horizontal legs 35 and 36' of angles 31 and 32, respectively, are cut away to receive the outermost channels 14 of each frame. Elongated cross plates 36 in the nature of elongated links are secured by bolts as shown in the positions of FIG. 1 on both sides of the rack. Bolts 37 are used for the attachment to the vertical legs of the angles 23, 24, 31 and 32. More specifically, certain sets of links 36 extend between vertical legs 30 and 34 on one side of the rack and other sets of links 36 extend between vertical legs 29 and 32' on the other side of the rack. The centers of each pair of links 36 are bolted to each other at 37'. The foregoing structure provides an extremely solid rack for storing a plurality of different sized rod-like members in openings 39 defined by the intersection of columns 14 and beam-like members 16.

A roller 40 is mounted for rotation behind the upper edge 17 of each beam-like member 16 in each opening 39, and the upper portion of roller 40 extends slightly above upper edge 17 (FIG. 8), the exact distance in this particular instance being about ⅛ of an inch. The aligned rollers 40 at each level of each frame 12 are supported in the following manner. A hexagonal rod 41 extends through aligned openings in the web of each channel 14. Hexagonal rod 41 is also press-fitted through the inner race 42 of bearings 43, with the outer race 44 being press-fitted into the outer portion of roller 40. Bearings 45 are located between the inner and outer races. Thus, the inner race will not be able to rotate relative to rod 41 and the outer races 43 will not be able to rotate relative to the outer portions of roller 40, so that rotation will be confined between the inner and outer races.

A plurality of rollers 46 are located at the lower ends of each frame 12. The rod 41' (FIG. 5), which is analogous to rod 41, is spacedly supported on plates 47 having their edges 49 (FIG. 5) welded in alignment with the webs of channels 14. Openings in plates 47 receive rod 41'. The ends of rods 41 and 41' are secured in position by nuts 42' and 42'', respectively. The rollers 46 are mounted on rods 41' in a manner analogous to that described above relative to FIG. 6. The rack of FIG. 1 is approximately 33 feet long, 7 feet high and about 7 feet wide. These measurements are strictly by way of example and not by limitation.

In order to load a bundle of rods 50 (FIG. 1), the length of which may be greater or lesser than 33 feet, into rack 10, a sling 51, which is attached to an overhead lifting device, is used. Initially, the sling 51, as shown in in solid lines, is attached to bundle 50 to lift it from the floor and align it with any one of the openings 39. Thereafter, the sling 51 is moved in the direction of arrow 52 to cause the bundle 50 to enter the aligned openings 39 of the various frames until such time as sling 51 reaches the dotted line position. The sling 51 is then lowered until the lower edge of bundle 50 rests on the upper surfaces of rollers 40. This is depicted by solid lines in FIG. 7. Continued lowering of sling 51 will cause the bundle 50 to tilt to the dotted line positions shown in FIGS. 1 and 7 so that the lower surface of bundle 50 will contact the relatively narrow upper edge 17 of angle 16 at the entry frame and the upper surface 53 (FIG. 8) will engage the relatively narrow lower edge 19 of an angle 16 on one of the inner frames 12. Thus, edge 19 will bite into the upper surface 53 of bundle 50 and edge 17 will bite into the lower surface of bundle 50. This biting action will be sufficient to hold the bundle in the tilted dotted line position as depicted by dotted line numeral 50 in FIG. 1. Continued lowering of sling 51 will cause the sling to lose contact with bundle 50 in its dotted line position and thereafter sling 51 can be moved to the position 51' in FIG. 1 to raise the end of bundle 50 to a substantially horizontal position and thereafter when sling 51' is moved to the left, the rod bundle will roll on rollers 40 and will be moved all the way into rack 10 so that it will occupy the dotted line position 50'' in the rack. If individual rods of bundle 50 are thereafter to be removed from the rack, this can be done manually. If the entire bundle is to be removed, it is to be noted that it can be moved out manually because the bundle rests on rollers 40 and the bundle can be rolled until a sufficient portion of the bundle extends outside of the rack so that the sling 51 can thereafter be used.

At this point it is to be noted that the upper leg 20 of each angle 16 is inclined in an upward direction toward its associated opening 39. Thus, the upper surface of each leg 20 acts to cam the bundle or a rod into the opening directly above it. At this time it is to be noted that a plate 53' is welded across the ends of each angle 16 at the entry frame 12 of the rack to reinforce it because it is this end frame which takes the greatest amount of shock when a bundle of rods is being loaded into the frame. The remainder of the frames 12 do not have reinforcing plates 53'. In addition, angle members 54 are welded to the legs of each channel 14 on each frame 12 of the rack to provide camming action for guiding the bundles of rods into the openings 39 toward which the inclined legs 55 and 56 are directed.

An inclined plate 57 is welded to the flange of I-beam 13 at the entry end of the rack to provide an inclined surface analogous to inclined surfaces 20 for guiding a bundle into an opening 39 immediately above plate 57.

A pair of tubular members 59 (FIG. 2) is mounted on each side of each frame 12. Each member 59 can receive a vertical rod to thereby provide a plurality of upstanding rods on each side of the frame, between which additional elongated rod-like members can be stored.

It can thus be seen that the improved rod storage rack of the present invention is manifestly capable of achieving the above enumerated objects, and while preferred embodiments of the improved rack have been disclosed, it will be appreciated that the present invention is not limited thereto but may be otherwise embodied within the scope of the following claims.

What is claimed is:

1. A rack for elongated rod-like members comprising a base, a plurality of frames mounted in aligned spaced relationship on said base, each of said frames comprising a plurality of vertical horizontally spaced columns, a plurality of horizontal vertically spaced beam-like members affixed to the columns of each of said frames to define openings in each of said frames with corresponding openings of all of said frames being in alignment, upper and lower biting edges on said beam-like members, rollers mounted on each of said frames behind each of said beam-like members with the upper portion of each of said rollers being slightly higher in elevation than the upper biting edge of the beam-like member adjacent thereto, and said lower biting edges being below said rollers, whereby said rod-like members will be carried by said rollers when said rod-like members are horizontal but will be bitingly engaged by the upper biting edge of one of said beam-like members of a frame at the end of said rack and the lower biting edge of another beam-like member at a higher elevation than the upper biting edge of said one of said beam-like members when the ends of said rod-like members outside of said rack tilt downwardly.

2. A rack for elongated rod-like members as set forth in claim 1 wherein said beam-like members comprise angles having upper and lower legs with the outer edges of their legs affixed to said columns.

3. A rack for elongated rod-like members as set forth in claim 2 wherein said upper biting edges comprise the outer edges of the upper legs of said angles.

4. A rack for elongated rod-like members as set forth in claim 3 wherein said lower biting edges comprise the outer edges of the lower legs of said angles.

5. A rack for elongated rod-like members comprising a base, a plurality of frames mounted in aligned spaced relationship on said base, each of said frames comprising a plurality of vertical horizontally spaced columns, a plurality of horizontal vertically spaced beam-like members affixed to the columns of each of said frames to define openings in each of said frames with corresponding openings of all of said frames being in alignment, upper and lower edges on said beam-like members, rollers mounted on each of said frames behind each of said beam-like members with the upper portion of each of said rollers being slightly higher in elevation than the upper edge of the beam-like member adjacent thereto, and said lower edges being below said rollers, whereby said rod-like members will be carried by said rollers when said rod-like members are horizontal but will be bitingly engaged by the upper edge of one of said beam-like members of a frame at the end of said rack and the lower edge of another beam-like member at a higher elevation than the upper edge of said one of said beam-like members when the ends of said rod-like members outside of said rack tilt downwardly, said beam-like members comprising angles having upper and lower legs with the outer edges of their legs affixed to said columns, said upper edges comprising the outer edges of the upper legs of said angles, said lower edges comprising the outer edges of the lower legs of said angles, and said angles including a junction of said upper and lower legs which is facing the direction in which said rod-like members are loaded into said rack, with said upper legs being inclined upwardly away from said junction so as to guide the ends of said rod-like members into said openings.

6. A rack for elongated rod-like members as set forth in claim 5 including inclined surfaces on certain of said columns for guiding said rod-like members into said openings.

7. A rack for elongated rod-like members as set forth in claim 6 wherein said columns comprise channels.

8. A rack for elongated rod-like members comprising a base, a plurality of frames mounted in aligned spaced relationship on said base, each of said frames comprising a plurality of vertical horizontally spaced columns, a plurality of horizontal vertically spaced beam-like members affixed to the columns of each of said frames to define openings in each of said frames with corresponding openings of all of said frames being in alignment, upper and lower edges on said beam-like members, rollers mounted on each of said frames behind each of said beam-like members with the upper portion of each of said rollers being slightly higher in elevation than the upper edge of the beam-like member adjacent thereto, and said lower edges being below said rollers, whereby said rod-like members will be carried by said rollers when said rod-like members are horizontal but will be bitingly engaged by the upper edge of one of said beam-like members of a frame at the end of said rack and the lower edge of another beam-like member at a higher elevation than the upper edge of said one of said beam-like members when the ends of said rod-like members outside of said rack tilt downwardly, and inclined surfaces on said beam-like members for guiding the ends of said rod-like members into said openings.

9. A rack for elongated rod-like members as set forth in claim 8 including inclined surfaces on said columns for guiding said rod-like members into said openings.

10. A rack for elongated rod-like members as set forth in claim 1 wherein said frames are substantially parallel to each other.

11. A rack for elongated rod-like members comprising a base, a plurality of frames mounted in aligned spaced relationship on said base, each of said frames comprising a plurality of vertical horizontally spaced columns, a plurality of horizontal vertically spaced beam-like members affixed to the columns of each of said frames to define openings in each of said frames with corresponding openings of all of said frames being in alignment, upper and lower edges on said beam-like members, said beam-like members comprising angles having upper and lower legs with the outer edges of said legs affixed to said columns, and with said upper legs being inclined upwardly toward said openings for camming said rod-like members into said openings.

12. A rack for elongated rod-like members as set forth in claim 11 including inclined surfaces on said columns for guiding said rod-like members into said openings.

13. A rack for elongated rod-like members as set forth in claim 11 wherein said frames are substantially parallel to each other.

14. A rack for elongated rod-like members comprising a base, a plurality of frames mounted in aligned spaced relationship on said base, each of said frames comprising a plurality of vertical horizontally spaced columns, a plurality of horizontal vertically spaced beam-like members affixed to the columns of each of said frames to define openings in each of said frames with corresponding openings of all of said frames being in alignment, upper and lower biting edges on said beam-like members for selectively biting into said rod-like members, whereby said rod-like members will be bitingly engaged by the upper biting edge of one of said beam-like members of a frame at the end of said rack and the lower biting edge of another beam-like member at a higher elevation than the upper biting edge of said one of said beam-like members when the ends of said rod-like members outside of said rack tilt downwardly.

15. A rack for elongated rod-like members as set forth in claim 14 wherein said beam-like members comprise angles having upper and lower legs with the outer edges of their legs affixed to said columns.

16. A rack for elongated rod-like members as set forth in claim 15 wherein said outer edges are relatively narrow to provide said biting engagement.

17. A rack for elongated rod-like members as set forth in claim 14 wherein said frames are substantially parallel.

* * * * *